US005511824A

United States Patent [19]

Kim

[11] Patent Number: 5,511,824

[45] Date of Patent: Apr. 30, 1996

[54] CONVERTIBLE ROLLER FOOTWEAR

[76] Inventor: Yong E. Kim, 197-53, Gung-dong, Guro-Ku, Seoul, Rep. of Korea

[21] Appl. No.: 380,754

[22] Filed: Jan. 31, 1995

[30] Foreign Application Priority Data

Jan. 31, 1994 [KR] Rep. of Korea ..... 94-1782

[51] Int. Cl.[6] ..... A63G 17/20

[52] U.S. Cl. ..... 280/841; 280/11.19; 280/11.27; 36/115

[58] Field of Search ..... 280/7.1, 7.17, 280/8, 11.19, 11.27, 841, 11.28, 43; 36/115

[56] References Cited

U.S. PATENT DOCUMENTS

| | | | |
|---|---|---|---|
| 2,114,790 | 4/1938 | Venables | 280/841 |
| 3,112,119 | 11/1963 | Sweet | 280/841 |
| 3,306,623 | 2/1967 | Weitzner | 280/841 |
| 3,884,485 | 5/1975 | Wälle | 280/841 |
| 4,150,497 | 4/1979 | Wang | 280/841 |
| 5,393,077 | 2/1995 | Wanous | 280/11.77 |
| 5,398,970 | 3/1995 | Tucky | 280/11.27 |

*Primary Examiner*—Richard M. Camby
*Attorney, Agent, or Firm*—Lowe, Price, LeBlanc & Becker

[57] ABSTRACT

A convertible roller footwear comprises: a sole; an elongate bushing embedded in the sole and extending in a transverse direction of the sole to terminate at opposite open ends, the bushing having an inner circumferential surface and generally hemispherical recesses disposed on the inner circumferential surface in the vicinity of the opposite ends of the bushing; a plurality of roller assemblies, each including a hollow nipple removably fitted into the bushing, the nipple having a radial through-hole formed adjacent to an internal end of the nipple to receive a ball therein, a pushpin slidably inserted through the nipple, the pushpin having an annular groove for selective communication with the radial through-hole, the pushpin movable between a pushed-in position for allowing the ball to move radially inwardly into engagement with the annular groove and a pulled-out position for causing the ball to move radially outwardly into engagement with the recesses, and a roller rotatably mounted on an external end of the nipple.

6 Claims, 3 Drawing Sheets

CONVERTIBLE ROLLER FOOTWEAR

FIELD OF THE INVENTION

The present invention pertains generally to a convertible roller footwear and, more particularly, to a roller footwear of the type including a pair of toe-side and heel-side bushings embedded in the sole of a footwear and a set of rollers detachably fitted to the opposite ends of the bushings. Attachment or removal of the rollers enable the roller footwear to be used both as a roller skate shoes and as a general-use walking footwear at the wearer's desire and preference.

DESCRIPTION OF THE PRIOR ART

Known in the art are dual-use roller footwears which may be converted into a working-purpose shoes and vice versa. As an exemplary prior art reference, Korean Utility Model Publication No. 90-11303 discloses a convertible roller shoes which comprises, as shown in FIG. 1, an outer sole 2 having fore and hind hangar spaces 6, each of which is open downwardly, and a set of rollers 4 foldably secured to the underside of the outer sole by means of support brackets 3, the support brackets 3 pivotable about a pivot axis 5 between a first position wherein the rollers 4 are folded into the hangar spaces 6 and a second position wherein the rollers 4 are unfolded out of the hangar spaces 6.

With the prior art roller footwear referred to just above, the hangar spaces should be large enough to accommodate the support brackets 3 and the rollers 4 in their entirety when the support brackets 3 remain in the first position. This leads to an unavoidable increase in the sole thickness, thus making the roller footwear less aesthetic in appearance and quite inconvenient for use as a walking-purpose shoes. Another disadvantage is that the thread joint of the pivot axis 5 has to be loosened and retightened through a cumbersome and time-consuming process each time the roller footwear is converted into the walking-purpose shoes and vice versa.

SUMMARY OF THE INVENTION

Accordingly, it is an object of the invention to provide a convertible roller footwear which can eliminate the drawbacks inherent in the prior art roller footwears and which enables conversion into a typical walking shoes to be carried out in a highly convenient fashion.

Another object of the invention is to provide a convertible roller footwear having a sole of reduced thickness and presenting an agreeable appearance even when the roller footwear is converted into a walking shoes.

With these objects in view, the present invention provides a convertible roller footwear comprising in combination: a sole; an elongate bushing embedded in the sole and extending in a transverse direction to terminate at opposite open ends, the bushing having an inner circumferential surface and generally hemispherical recesses disposed on the inner circumferential surface in the vicinity of the opposite ends of the bushing; a plurality of roller assemblies, each including a hollow nipple removably fitted into the bushing, the nipple having a radial through-hole formed adjacent to an internal end of the nipple to receive a ball therein, a pushpin slidably inserted through the nipple, the pushpin having an annular groove for selective communication with the radial through-hole, the pushpin movable between a pushed-in position for allowing the ball to move radially inwardly into engagement with the annular groove and a pulled-out position for causing the ball to move radially outwardly into engagement with the recesses, and a roller rotatably mounted on an external end of the nipple.

BRIEF DESCRIPTION OF THE DRAWINGS

Other objects, features and advantages of the invention will become apparent from the following description of the preferred embodiment taken in conjunction with the accompanying drawings in which.

DETAILED DESCRIPTION OF THE PREFERRED EMBODIMENT

Figure 1:
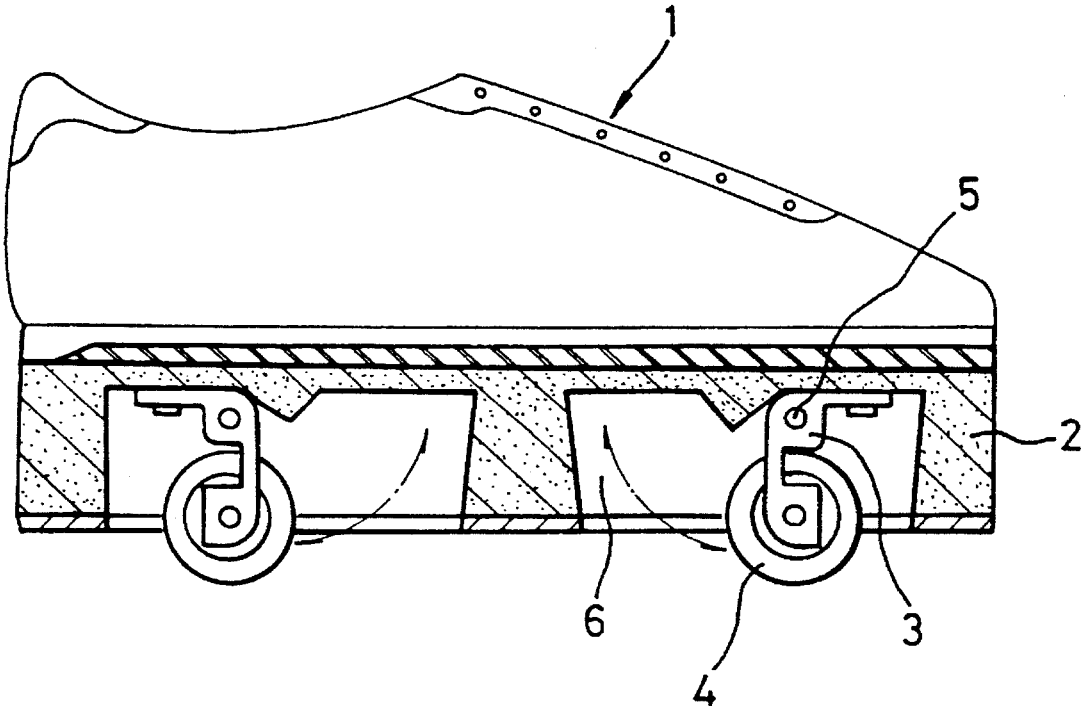
FIG. 1 (PRIOR ART)
FIG. 1 is a partially sectional view showing the prior art roller footwear which has foldable rollers attached to the sole of the footwear.
Figure 2:
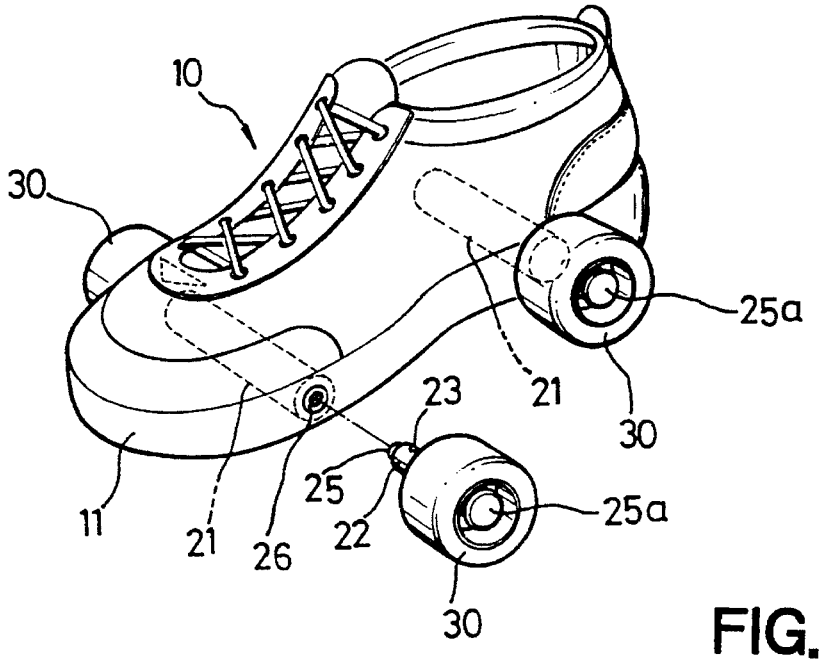
FIG. 2 is a perspective view of the convertible roller footwear in accordance with the invention, with one roller assembly detached from the sole for the sake of illustration.

As shown in FIG. 2, the convertible roller footwear 10 includes, inter alia, a sole 11 having toe-side and heel-side transverse holes, an elongate bushing 21 fixedly embedded in each of the transverse holes and a set of roller assemblies 30 detachably fitted to the bushing 21 for keeping the sole 11 out of contact with the ground surface. Detachability of the roller assemblies 30 from the sole 11 makes it possible for the wearer to convert the roller footwear into a walking shoes at the wearer's desire.

Figure 3:
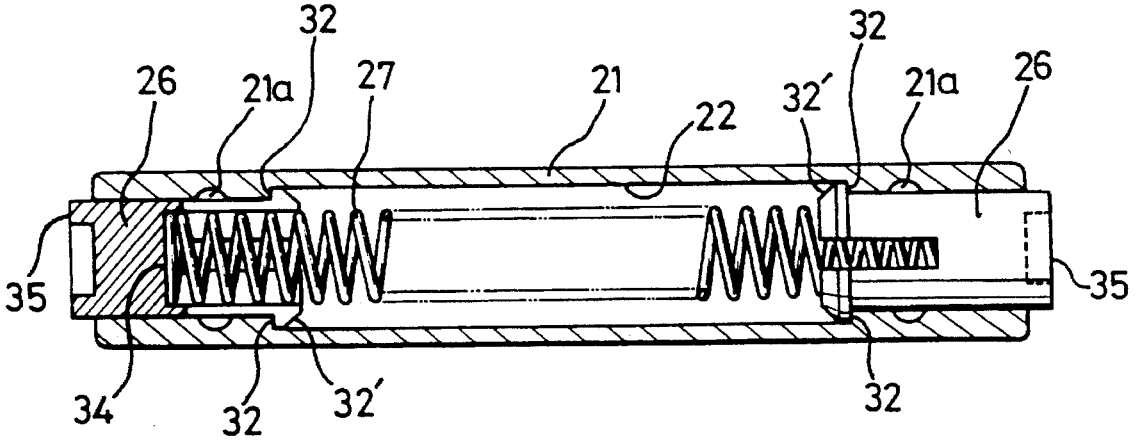
FIG. 3 is a sectional view illustrating the elongate bushing embedded in the sole of the convertible roller footwear.

Referring the FIG. 3, there is best shown the elongate bushing 21 that extends in a transverse direction to terminate at its opposite open ends. The bushing 21 has an inner circumferential surface 22, an array of generally hemispherical recesses 21*a* disposed on the inner circumferential surface 22 in the vicinity of the opposite ends of the bushing 21 and a pair of spaced apart shoulders 32 each formed axially inwardly of the hemispherical recesses 21*a*. Slidably fitted into the bushing 21 is a couple of sliding inserts 26 which in turn have an enlarged head 32' for abutment to the respective shoulder 32. A compression spring 27 is retained within the bushing 21 to bias the sliding inserts 26 toward the opposite ends of the bushing 21 so that the enlarged head 32' of the sliding inserts 26 can be brought into contact with the shoulders 32 of the bushing 21.

Figure 4:
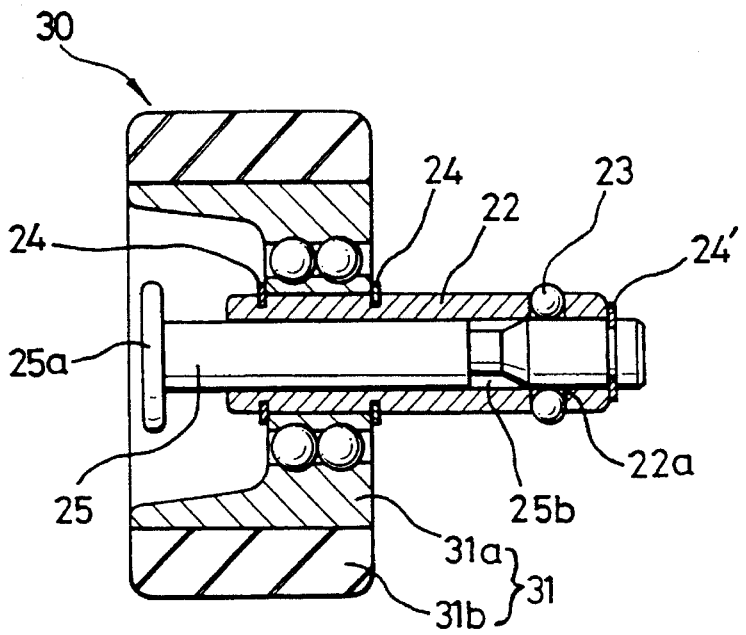
FIG. 4 is a sectional view depicting the roller assembly detachably fitted to the opposite ends of the bushing.

FIG. 4 shows one embodiment of the roller assemblies 30 which can be detachably attached to the sole 11 set forth hereinabove. The roller assembly 30 illustrated in FIG. 4 includes a hollow nipple 22 removably fitted into the bushing 21. The nipple 22 has at least one radial through-hole 22*a* formed adjacent to an internal end of the nipple 22 to receive a ball 23 therein. Slidably inserted through the nipple 22 is a pushpin 25 that has an annular groove 25*b* for selective communication with the radial through-hole 22*a*. It should be appreciated that the pushpin 25 is movable between a pushed-in position for allowing the ball 23 to move radially inwardly into engagement with the annular groove 25*b* and a pulled-out position for causing the ball 23 to move radially outwardly into engagement with the hemispherical recesses 21*a* of the bushing 21. Rotatably mounted on an external end of the nipple 22 is a roller 31 that consists of a bearing 31*a* with inner and outer races and an elastic rubber layer 31*b* adhesively bonded to the outer race of the bearing 31*a*.

The nipple 22 is provided at its external end with a pair of snap rings 24 which serve to hold the roller 31 in place. Preferably, the radial through-hole 22*a* of the nipple 22 is so configured as to have the smallest diameter at an outer circumference of the nipple 22 and the greatest diameter at an inner circumference of the nipple 22. The smallest diameter should be selected such that the ball 23 is inhibited from escapement out of the radial through-hole 22*a*. In the illustrated embodiment, the pushpin 25 has a disk-like knob 25*a* provided at the external end thereof and a retainer ring 24' fitted at the internal end thereof to prevent unwanted removal of the pushpin 25 away from the nipple 22. Moreover, the annular groove 25*b* of the pushpin 25 is defined by an external-end-side perpendicular surface and an internal-end-side sloping surface such that the ball 23 can readily move into and out of the annular groove 25*b* as the pushpin 25 is subjected to sliding movement between the pushed-in and pulled-out positions.

Figure 5:
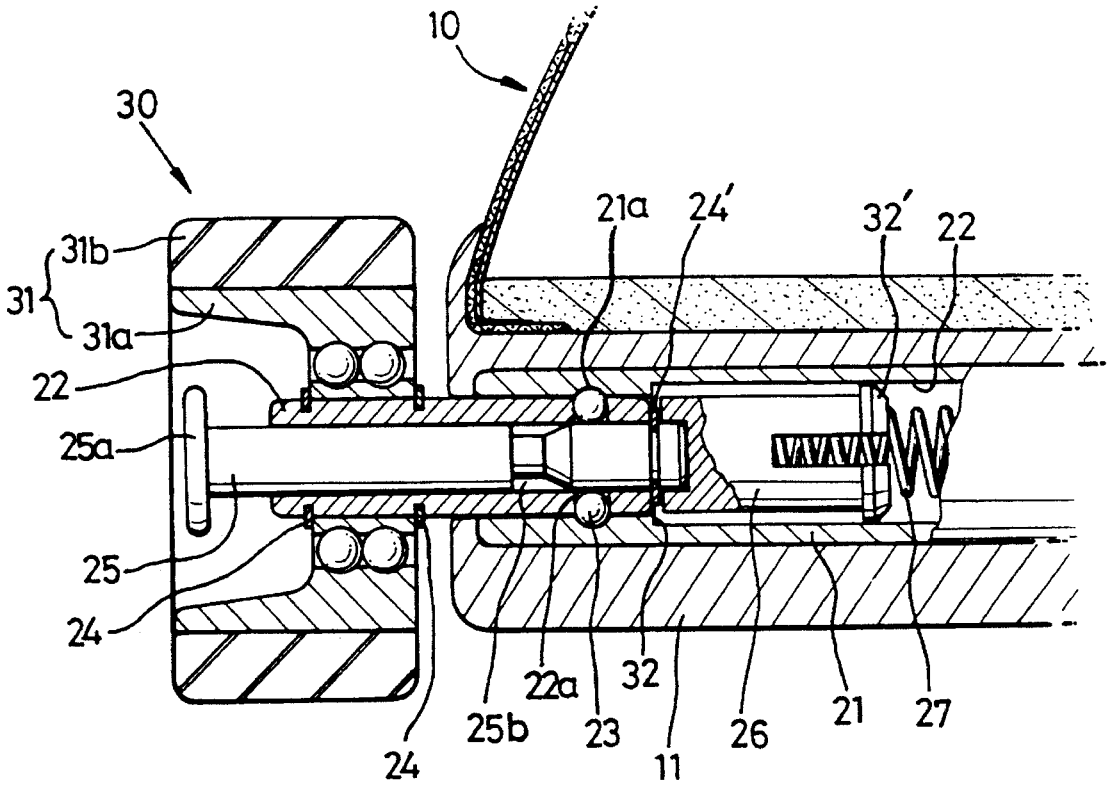
FIG. 5 is an enlarged sectional view of the convertible roller footwear wherein the roller assembly is fitted into the bushing.

With reference to FIG. 5, description will now be given regarding how to attach and detach the roller assembly 30 to and from the flank side of the sole 11.

As stated above, the bushing 21 is kept embedded in the shoe sole 11 at each of the toe-side and heel-side locations. The sliding inserts 26 within the bushing 21 are urged away from each other by virtue of the compression spring 27, ensuring that the enlarged head 32' of the respective sliding insert 26 may come into abutment to each of the shoulders 32 of the bushing 21. Under this state, the external end of the respective sliding insert 26 becomes flush with the flank surface of the sole 11 to thereby make the surface irregularity of the sole 11 less conspicuous.

To attach the roller assembly 30 to the sole 11, the pushpin 25 should first be brought into the pushed-in position by way of manually pressing the disk-like knob 25*a* with respect to the nipple 22. In response, the ball 23 is allowed to move radially inwardly into the annular groove 25*b* of the pushpin 25 and, therefore, does not protrude over the outer circumference of the nipple 22. Subsequently, the roller assembly 30 is positioned at the enterance of the bushing 21 so that the internal end of the pushpin 25 rests against the sliding insert 26. Pressing the roller assembly 30 toward the sole 11 will cause the nipple 22 to slide into the bushing 21 until the radial through-hole 22*a* of the nipple 22 coincides with the hemispherical recess 21*a* of the bushing 21. The pushpin 25 is then manually retracted into the pulled-out position as illustrated in FIGS. 4 and 5. At this moment, the ball 23 is caused to move radially outwardly into engagement with the hemispherical recess 21*a*, thus making the nipple 22 immovable with regard to the bushing 21. Now that the sliding insert 26 is urged toward the pushpin 25 by means of the compression spring 27, the pushpin 25 continues to remain in the pulled-out position unless an external pressing force is exerted on the disk-like knob 25*a*. With the roller assembly 30 attached to the sole 11, the footwear 10 serves as a roller skate, as distinguished from a walking shoes.

To demount the roller assembly 30 from the sole 11, the first step is to exert a pressing force on the pushpin 25 to have the latter slide into the pushed-in position against the sliding insert 26. The ball 23 will move radially inwardly into the annular groove 25*b* of the pushpin 25 so that it can be out of engagement with the hemispherical recess 21*a* of the bushing 21. Pulling the roller assembly 30 away from the sole 11 will result in the nipple 22 being removed from the bushing 21. Concurrently, the sliding insert 26 is pushed axially outwardly by means of the compression spring 27 until the enlarged head 32' thereof comes into contact with the shoulder 32 of the bushing 21. Under this state, the external end surface of the sliding insert 26 becomes flush with the flank surface of the sole 11 so as not to mar the appearance of the footwear. The sliding insert 26 serves also to prohibit any foreign matters from enterance into the bushing 21. In this way, the roller footwear 10 can be converted into a walking shoes and vice versa in a highly convenient manner.

While the invention has been shown and described with reference to a preferred embodiment, it should be apparent to those skilled in the art that many changes and modifications may be made without departing from the spirit and scope of the invention as defined in the claims.

What is claimed is:

1. A convertible roller footwear comprising in combination:

a sole;

an elongate bushing embedded in the sole and extending in a transverse direction to terminate at opposite open ends, the bushing having an inner circumferential surface and generally hemispherical recesses disposed on the inner circumferential surface in the vicinity of the opposite ends of the bushing;

a plurality of roller assemblies, each including a hollow nipple removably fitted into the bushing, the nipple having a radial through-hole formed adjacent to an internal end of the nipple to receive a ball therein, a pushpin slidably inserted through the nipple, the pushpin having an annular groove for selective communication with the radial through-hole, the pushpin movable between a pushed-in position for allowing the ball to move radially inwardly into engagement with the annular groove and a pulled-out position for causing the ball to move radially outwardly into engagement with the recesses, and a roller rotatably mounted on an external end of the nipple.

2. The convertible roller footwear as recited in claim 1, wherein the bushing is provided with a pair of spaced apart shoulders on the inner circumferential surface thereof and, further comprising a pair of sliding inserts slidably fitted into the bushing, each of the sliding inserts having an enlarged head for abutment to the respective shoulder, and a compression spring retained within the bushing for biasing the pair of sliding inserts toward the opposite ends of the bushing to thereby bring the enlarged head into contact with the respective shoulder.

3. The convertible roller footwear as recited in claim 1, wherein the nipple is provided with a pair of snap rings for holding the roller in place and the radial through-hole is configured to have a smallest diameter at an outer circumference of the nipple and a greatest diameter at an inner circumference of the nipple, whereby the ball is inhibited from escapement out of the radial through-hole.

4. The convertible roller footwear as recited in claim 1, wherein the pushpin has a disk-like knob provided at the external end thereof and a retainer ring fitted at the internal end thereof to prevent inadvertent removal of the pushpin from the nipple.

5. The convertible roller footwear as recited in claim 1, wherein the annular groove of the pushpin is defined by an external-end-side perpendicular surface and an internal-end-side sloping surface such that the ball can readily move into and out of the annular groove as the pushpin is slid between the pushed-in and pulled-out positions.

6. The convertible roller footwear as recited in claim 1, wherein the roller includes a bearing with inner and outer races and an elastic rubber layer adhesively bonded to the outer race of the bearing.

* * * * *